US011191335B2

(12) United States Patent
Moore et al.

(10) Patent No.: US 11,191,335 B2
(45) **Date of Patent: *Dec. 7, 2021**

(54) HAIR STYLING APPLIANCE

(71) Applicant: Jemella Limited, Leeds (GB)

(72) Inventors: Timothy David Moore, Hertfordshire (GB); Robert Alexander Weatherly, Cambridge (GB)

(73) Assignee: Jemella Limited, Leeds (GB)

( * ) Notice: Subject to any disclaimer, the term of this patent is extended or adjusted under 35 U.S.C. 154(b) by 179 days.

This patent is subject to a terminal disclaimer.

(21) Appl. No.: 16/241,412

(22) Filed: Jan. 7, 2019

(65) Prior Publication Data

US 2019/0133283 A1 May 9, 2019

Related U.S. Application Data

(63) Continuation of application No. 14/409,651, filed as application No. PCT/GB2013/051636 on Jun. 21, 2013, now Pat. No. 10,213,000.

(30) Foreign Application Priority Data

Jun. 25, 2012 (GB) ..... 1211231
Aug. 20, 2012 (GB) ..... 1214775

(51) Int. Cl.
*A45D 1/04* (2006.01)
*A45D 1/00* (2006.01)
(Continued)

(52) U.S. Cl.
CPC ..... *A45D 1/04* (2013.01); *A45D 1/00* (2013.01); *A45D 1/28* (2013.01); *A45D 2/001* (2013.01);
(Continued)

(58) Field of Classification Search
CPC ..... A45D 2001/045; A45D 2001/004; A45D 2/001; A45D 1/28; A45D 1/00; A45D 1/04
(Continued)

(56) References Cited

U.S. PATENT DOCUMENTS 824,742 A 7/1906 Richardson
866,778 A 9/1907 Eldridge
(Continued)

FOREIGN PATENT DOCUMENTS

CN 2503759 Y 8/2002
CN 102045899 A 5/2011
(Continued)

OTHER PUBLICATIONS

"U.S. Appl. No. 14/409,651, Examiner Interview Summary dated Apr. 10, 2018", 3 pgs.
(Continued)

*Primary Examiner* — Jimmy Chou
(74) *Attorney, Agent, or Firm* — Schwegman Lundberg & Woessner, P.A.

(57) ABSTRACT

A hair styling appliance for dual supply voltage operation is described comprising a body having at least one arm bearing a hair styling heater (560), wherein the hair styling heater comprises one or more heater electrodes (630,632,634,636) for heating the hair styling heater. A first power input is connectable to a battery power source (564) and a second power input is connectable to a mains powered source (561). The first power input and the second power input are each coupled to at least one of the one or more heater electrodes. Such a hair styling appliance is useable for styling when coupled to the mains powered source and when coupled to the battery power source increasing the versatility of the appliance.

18 Claims, 8 Drawing Sheets

(51) Int. Cl.
*A45D 1/28* (2006.01)
*A45D 2/00* (2006.01)

(52) U.S. Cl.
CPC .. *A45D 2001/004* (2013.01); *A45D 2001/045* (2013.01)

(58) Field of Classification Search
USPC ..... 219/207, 225, 506, 222, 223, 224, 226, 219/505, 533, 240, 242
See application file for complete search history.

(56) References Cited

U.S. PATENT DOCUMENTS 1,562,349 A * 11/1925 Lorenze et al. ..... A45D 1/04 219/242
3,182,667 A 5/1965 Den
4,045,763 A * 8/1977 Miyamoto ..... A45D 1/28 338/23
4,196,343 A 4/1980 Han
4,267,430 A 5/1981 Downey
4,354,092 A * 10/1982 Manabe ..... H05B 3/42 132/232
4,365,140 A * 12/1982 Bast ..... A45D 1/04 132/232
4,408,282 A * 10/1983 Hof ..... G01N 27/223 324/603
4,424,437 A 1/1984 Walter et al.
4,553,343 A 11/1985 Primati et al.
4,757,183 A * 7/1988 Karey ..... A45D 20/10 392/341
4,857,702 A * 8/1989 Cafaro ..... A45D 1/04 219/225
4,883,942 A * 11/1989 Robak, Sr. ..... A45D 1/04 219/227
4,917,078 A 4/1990 Zaborowski
4,953,266 A 9/1990 Trinkaus
5,124,532 A * 6/1992 Hafey ..... A45D 1/00 132/229
5,160,831 A * 11/1992 Thaler ..... G05D 23/1951 219/240
5,195,253 A * 3/1993 Poumey ..... A45D 20/04 34/97
5,223,694 A * 6/1993 Tsuji ..... A45D 1/04 132/118
5,243,683 A 9/1993 Yang
5,345,055 A * 9/1994 Leung ..... A45D 1/28 132/227
5,394,620 A * 3/1995 Chimera ..... A45D 20/10 34/97
5,400,809 A * 3/1995 Adams ..... A45D 20/50 132/118
5,794,799 A * 8/1998 Collins ..... A45D 1/20 211/60.1
5,857,262 A * 1/1999 Bonnema ..... A45D 20/06 34/97
5,865,188 A 2/1999 Marquez
5,938,957 A * 8/1999 Tanahashi ..... H05B 3/845 219/219
5,952,812 A 9/1999 Maeda
6,064,799 A * 5/2000 Anderson ..... H01L 21/67115 219/390
6,070,596 A * 6/2000 Altamore ..... A45D 1/04 132/224
6,119,702 A * 9/2000 Habibi ..... A45D 1/04 132/118
6,191,930 B1 * 2/2001 Ramchandani ..... A45D 20/12 361/213
6,199,295 B1 3/2001 Smal
6,314,236 B1 * 11/2001 Taylor ..... A45D 20/10 200/50.01
6,369,369 B2 * 4/2002 Kochman ..... A41D 13/0051 219/528
6,393,718 B1 5/2002 Harris et al.
6,449,870 B1 * 9/2002 Perez ..... A45D 20/12 34/96
6,457,953 B1 10/2002 Bradbury et al.
6,494,216 B1 12/2002 Hirata
6,627,852 B1 9/2003 Savone
6,703,587 B2 * 3/2004 Sena ..... A45D 1/20 219/222
6,732,449 B2 * 5/2004 Evanyk ..... A45D 20/12 34/96
D527,176 S 8/2006 Andre et al.
7,380,347 B2 * 6/2008 Coats ..... A45D 20/12 34/97
7,445,012 B2 * 11/2008 Mukai ..... A45D 1/04 132/224
7,465,904 B2 * 12/2008 Kim ..... A45D 1/04 132/228
7,730,895 B2 * 6/2010 Maddocks ..... A45D 1/06 132/224
7,748,391 B2 7/2010 Vance
7,783,177 B2 * 8/2010 Ikesaki ..... A45D 1/04 392/380
8,013,275 B2 * 9/2011 Ng ..... B26B 19/46 219/225
8,232,761 B1 * 7/2012 Thivierge ..... H02J 1/06 320/101
8,541,715 B2 * 9/2013 Overend ..... A45D 1/28 219/225
8,544,476 B1 10/2013 Marquardt et al.
8,567,414 B2 * 10/2013 Rivola ..... A45D 1/06 132/224
8,567,415 B2 * 10/2013 Morgandi ..... A45D 2/40 132/224
8,776,805 B2 * 7/2014 deGrood ..... A45D 1/04 132/224
8,890,035 B2 * 11/2014 Scheunert ..... A45D 20/12 219/222
D719,296 S * 12/2014 Brady ..... D28/35
9,012,813 B2 * 4/2015 Mourad ..... A45D 1/04 219/225
9,474,347 B2 * 10/2016 Pedroarena ..... A45D 20/12
9,526,311 B1 * 12/2016 Schaefer ..... A45D 20/10
9,698,767 B2 7/2017 Tuttle et al.
10,213,000 B2 * 2/2019 Moore ..... A45D 1/00
2001/0014373 A1 8/2001 Lin
2002/0157276 A1 * 10/2002 Mujica ..... A45D 20/10 34/97
2002/0189128 A1 12/2002 Nakagawa et al.
2003/0007872 A1 1/2003 Bradbury et al.
2003/0089700 A1 * 5/2003 Chang ..... H05B 1/0252 219/505
2004/0003824 A1 1/2004 Habibi
2004/0041684 A1 3/2004 Mandell et al.
2004/0108309 A1 * 6/2004 Dempsey ..... G03G 15/205 219/484
2005/0121050 A1 * 6/2005 Cha ..... A45D 1/04 132/229
2005/0224091 A1 * 10/2005 Cafaro ..... A45D 1/04 132/228
2006/0081586 A1 * 4/2006 Ramsay ..... A45D 20/12 219/235
2006/0124922 A1 * 6/2006 Kim ..... H01L 51/0022 257/40
2006/0150996 A1 * 7/2006 Lun ..... A45D 1/06 132/224
2006/0202852 A1 * 9/2006 Peter ..... G01V 11/002 340/854.6
2007/0163614 A1 * 7/2007 Ikesaki ..... A45D 2/001 132/229
2007/0209673 A1 * 9/2007 Choi ..... A45D 1/06 132/224
2007/0220773 A1 9/2007 Evanyk et al.
2007/0283529 A1 12/2007 Hashizume et al.
2007/0283978 A1 * 12/2007 Montagnino ..... A45D 1/20 132/211
2008/0041409 A1 * 2/2008 Leung ..... A45D 1/04 132/224

(56) References Cited

U.S. PATENT DOCUMENTS

2008/0053982 A1* 3/2008 Ceva ..... A45D 1/04 219/225
2008/0087295 A1* 4/2008 Park ..... A45D 1/02 132/232
2008/0092915 A1* 4/2008 Chan ..... A45D 6/20 132/232
2008/0173322 A1* 7/2008 Leung ..... A45D 2/001 132/232
2008/0196739 A1* 8/2008 Henninger ..... A45D 1/04 132/224
2008/0216859 A1* 9/2008 Chan ..... A45D 1/04 132/224
2008/0216860 A1 9/2008 Legrain
2008/0236604 A1* 10/2008 Mourad ..... A45D 20/50 132/118
2008/0236609 A1 10/2008 Wong et al.
2008/0240690 A1* 10/2008 Ono ..... A45D 20/10 392/384
2008/0257372 A1* 10/2008 Mills ..... A45D 1/04 132/224
2008/0283080 A1* 11/2008 Habibi ..... A45D 2/40 132/224
2009/0005723 A1* 1/2009 Shanks ..... A61H 35/006 604/20
2009/0032048 A1* 2/2009 Suzuki ..... A45D 1/06 132/224
2009/0044823 A1* 2/2009 Overend ..... A45D 1/28 132/211
2009/0114240 A1* 5/2009 Leung ..... A45D 1/04 132/224
2009/0127246 A1* 5/2009 Hendricks ..... F24C 15/005 219/452.11
2009/0159093 A1* 6/2009 Yu ..... A45D 1/04 132/211
2009/0180765 A1* 7/2009 Yeh ..... F24D 11/002 392/341
2009/0293300 A1 12/2009 Merritt
2010/0083978 A1 4/2010 Hottenrott et al.
2010/0101598 A1* 4/2010 Ng ..... A45D 2/001 132/223
2010/0132733 A1* 6/2010 Kyu ..... A45D 1/04 132/229
2010/0193505 A1* 8/2010 Peck ..... H05B 3/62 219/548
2010/0224206 A1* 9/2010 Serresvives ..... A45D 1/04 132/212
2011/0011847 A1* 1/2011 Soerensen ..... H05B 3/146 219/553
2011/0017225 A1* 1/2011 Devulapalli ..... A45D 1/04 132/118
2011/0056509 A1* 3/2011 Benest ..... F25B 21/02 132/223
2011/0079237 A1 4/2011 Price
2011/0091251 A1* 4/2011 Kim ..... H05B 3/0095 399/333
2011/0129596 A1* 6/2011 Lee ..... H01L 51/0008 427/64
2011/0226277 A1* 9/2011 Choi ..... A45D 1/04 132/224
2012/0031765 A1* 2/2012 Curran ..... C25D 11/16 205/50
2012/0227758 A1* 9/2012 Ford ..... A45D 1/04 132/211
2012/0261266 A1* 10/2012 Blawert ..... C25D 11/34 205/50
2012/0291797 A1* 11/2012 deGrood ..... A45D 1/28 132/211
2013/0220360 A1* 8/2013 Sharon ..... C04B 35/10 132/269
2013/0239427 A1 9/2013 Quessard et al.
2013/0266300 A1* 10/2013 Kreutzman ..... F24H 9/1818 392/501
2014/0130365 A1 5/2014 Dineen
2014/0338691 A1* 11/2014 Weatherly ..... A45D 1/02 132/228
2015/0122792 A1* 5/2015 Moore ..... A45D 1/04 219/222
2015/0136169 A1* 5/2015 Moore ..... A45D 2/001 132/225
2015/0216280 A1* 8/2015 Sayers ..... A45D 1/06 132/269
2015/0313339 A1* 11/2015 Moore ..... A45D 20/08 132/224
2015/0335120 A1 11/2015 Moore et al.
2016/0286928 A1* 10/2016 Weatherly ..... A45D 1/04

FOREIGN PATENT DOCUMENTS

DE 3115569 A1 12/1982
DE 102010002795 A1 9/2011
EP 2077343 A1 7/2009
EP 2255692 A1 12/2010
EP 1951082 B1 10/2011
EP 2377419 A1 10/2011
GB 235937 A 6/1925
GB 573009 A 11/1945
GB 1519930 A 8/1978
GB 2016051 A 9/1979
GB 2067097 A 7/1981
GB 2142817 A 1/1985
GB 2163574 A 2/1986
GB 2167946 A 6/1986
GB 2318544 A 4/1998
GB 2477834 A 8/2011
GB 2503521 A 1/2014
JP 08256818 A 10/1996
JP 2008104499 A 5/2008
JP 2010274050 A 12/2010
KR 20070083323 A 8/2007
KR 100858147 B1 9/2008
KR 20090015175 A 2/2009
KR 20090119155 A 11/2009
KR 1020090119155 A 11/2009
KR 20100041337 A 4/2010
KR 1020110106051 A 9/2011
SU 1567169 A1 5/1990
WO WO-8000783 A1 5/1980
WO WO-9603013 A1 2/1996
WO WO-9610349 A1 4/1996
WO WO-0111924 A1 2/2001
WO WO-0221967 A1 3/2002
WO WO-2004006712 A1 1/2004
WO WO-2007043732 A1 4/2007
WO WO-2007078048 A1 7/2007
WO WO-2008064075 A2 5/2008
WO WO-2009136739 A2 11/2009
WO WO-2012028862 A1 3/2012
WO WO-2012076885 A2 6/2012
WO WO-2014001769 A1 1/2014

OTHER PUBLICATIONS

"U.S. Appl. No. 14/409,651, Examiner Interview Summary dated Aug. 27, 2018", 3 pgs.
"U.S. Appl. No. 14/409,651, Final Office Action dated Dec. 8, 2017", 21 pgs.
"U.S. Appl. No. 14/409,651, Non Final Office Action dated May 1, 2018", 12 pgs.
"U.S. Appl. No. 14/409,651, Non Final Office Action dated May 25, 2017", 24 pgs.
"U.S. Appl. No. 14/409,651, Notice of Allowance dated Oct. 17, 2018", 9 pgs.
"U.S. Appl. No. 14/409,651, Preliminary Amendment filed Dec. 19, 2014", 7 pgs.
"U.S. Appl. No. 14/409,651, Response filed Mar. 30, 2017 to Restriction Requirement dated Dec. 30, 2016", 7 pgs.
"U.S. Appl. No. 14/409,651, Response filed Sep. 25, 2017 to Non Final Office Action dated May 25, 2017", 15 pgs.

(56) References Cited

OTHER PUBLICATIONS

"U.S. Appl. No. 14/409,651, Response filed Apr. 6, 2018 to Final Office Action dated Dec. 8, 2017", 12 pgs.
"U.S. Appl. No. 14/409,651, Response filed Aug. 16, 2018 to Non-Final Office Action dated May 7, 2018", 7 pgs.
"U.S. Appl. No. 14/409,651, Restriction Requirement dated Dec. 30, 2016", 8 pgs.
"European Application Serial No. 13731472.0, Intention to grant dated Jan. 26, 2017", 40 pgs.
"European Application Serial No. 13731472.0, Response filed May 27, 2015 to Communication pursuant to Rules 161(1) and 162 EPC dated Feb. 14, 2015", 18 pgs.
"European Application Serial No. 13796133.0, Communication pursuant to Article 94(3) EPC dated Aug. 18, 2016", 6 pgs.
"European Application Serial No. 15165491.0, Extended European Search Report dated Aug. 21, 2015", 9 pgs.
"European Application Serial No. 15165491.0, Response filed Mar. 15, 2016 to Extended European Search Report dated Aug. 21, 2015", 28 pgs.
"International Application Serial No. PCT/GB2013/051636, International Preliminary Report on Patentability dated Jan. 8, 2015", 12 pgs.
"International Application Serial No. PCT/GB2013/051636, International Search Report dated Nov. 7, 2013", 8 pgs.
"International Application Serial No. PCT/GB2013/051636, Written Opinion dated Nov. 7, 2013", 8 pgs.
"International Application Serial No. PCT/GB2013/051648, International Preliminary Report on Patentability dated Jan. 8, 2015", 9 pgs.
"International Application Serial No. PCT/GB2013/051648, International Search Report dated Jan. 17, 2014", 5 pgs.
"International Application Serial No. PCT/GB2013/051648, Written Opinion dated Jan. 17, 2014", 7 pgs.
"International Application Serial No. PCT/GB2013/052188, International Search Report dated Dec. 18, 2013", 6 pgs.
"International Application Serial No. PCT/GB2013/052188, Written Opinion dated Dec. 18, 2013", 11 pgs.
"International Application Serial No. PCT/GB2013/053057, International Search Report dated Mar. 18, 2014", 6 pgs.
"International Application Serial No. PCT/GB2013/053057, Written Opinion dated Mar. 18, 2014", 10 pgs.
"United Kingdom Application Serial No. 1211231.4, Office Action dated Oct. 19, 2012", 6 pgs.
"United Kingdom Application Serial No. 1211231.4, Response filed Aug. 14, 2013 to Office Action dated Oct. 19, 2012", 12 pgs.
"United Kingdom Application Serial No. 1212933.4, Search Report dated Feb. 21, 2013".
"United Kingdom Application Serial No. 1212933.4, Search Report dated Oct. 16, 2012".
"United Kingdom Application Serial No. 1214775.7, Office Action dated Apr. 19, 2013", 4 pgs.
"United Kingdom Application Serial No. 1214775.7, Office Action dated Nov. 9, 2012", 4 pgs.
"United Kingdom Application Serial No. 1214777.3, Search Report dated Nov. 13, 2012", 5 pgs.
"United Kingdom Application Serial No. 1221671.9, Search Report dated Mar. 26, 2013", 4 pgs.
"United Kingdom Application Serial No. 1221674.3, Search Report dated Mar. 19, 2013".
"United Kingdom Application Serial No. 1306648.5, Search Report dated Sep. 19, 2013", 4 pgs.
"United Kingdom Application Serial No. 1720073.4, Combined Search and Examination Report dated Jan. 30, 2018", 7 pgs.
Curran, J A, et al., "Thermo-Physical Properties of Plasma Electrolytic Oxide Coatings on Aluminium", Surface and Coatings Technology, Elsevier, Amsterdam, NL, vol. 199, No. 2-3, (Sep. 22, 2005), 168-176.

* cited by examiner

HAIR STYLING APPLIANCE

PRIORITY APPLICATIONS

This application is a continuation of U.S. application Ser. No. 14/409,651, filed on Dec. 19, 2014, which is a U.S. National Stage Filing under 35 U.S.C. 371 from International Application No. PCT/GB2013/051636, filed on Jun. 21, 2013, and published as WO2014/001769 on Jan. 3, 2014, which claims the benefit of priority to United Kingdom Application No. 1214775.7, filed on Aug. 20, 2012 and to United Kingdom Application No. 1211231.4, filed on Jun. 25, 2012; the benefit of priority of each of which is hereby claimed herein, and which applications and publication are hereby incorporated herein by reference in their entirety.

FIELD OF THE INVENTION

This invention relates to hair styling appliances, in particular low voltage, for example battery operated devices.

BACKGROUND TO THE INVENTION

There are a variety of apparatus available for styling hair. One form of apparatus is known as a straightener which employs plates that are heatable. To style, hair is clamped between the plates and heated above a transition temperature where it becomes mouldable. Depending on the type, thickness, condition and quantity of hair, the transition temperature may be in the range of 160-200° C.

A hair styling appliance can be employed to straighten, curl and/or crimp hair.

A hair styling appliance for straightening hair is commonly referred to as a "straightening iron" or "hair straightener". FIG. 1 depicts an example of a typical hair straightener 1. The hair straightener 1 includes first and second arms each comprising an arm member 4*a*, 4*b* and heatable plates 6*a*, 6*b* coupled to heaters (not shown) in thermal contact with the heatable plates. The heatable plates are substantially flat and are arranged on the inside surfaces of the arms in an opposing formation. During the straightening process, hair is clamped between the hot heatable plates and then pulled under tension through the plates so as to mould it into a straightened form. The hair straightener may also be used to curl hair by rotating the hair straightener 180° towards the head prior to pulling the hair through the hot heatable plates.

A hair styling appliance for crimping hair is commonly referred to as a "crimping iron". FIG. 2 depicts an example of a typical crimping iron 10). The crimping iron includes first and second arms, Each arm comprises an arm member 14*a*, 14*b* and heatable plates 16*a*, 16*b* coupled to heaters (not shown) in thermal contact with the heatable plates. The heating plates have a saw tooth (corrugated, ribbed) surface and are arranged on the inside surfaces of the arms in an opposing formation. During the crimping process, the hair is clamped between the hot heatable plates until it is moulded into a crimped shape.

A hair styling appliance for curling hair (not shown) typically has a single arm bearing a cylindrical heater, not necessarily of circular cross-section, around which the hair is wrapped.

Hair styling appliances typically have a ceramic heater, which aids optimisation of the thermal control loop, thus allowing the plates in contact with hair to remain near transition temperature during styling and thermal load application. This leads to longevity of style.

Conventional ceramic heaters typically comprise a layered structure having an electrical heater electrode sandwiched between two layers of ceramic/embedded within the ceramic plate. A heatable plate is then thermally coupled to the heater, on one side of the heater/ceramic sandwich, which provides a contact surface for styling hair.

The temperature range required, user expectations with regard to the time to heat-up, thermal control, and other factors combine to drive existing hair styling appliances to employ mains power for the heater(s).

The inventors have, however, recognised that a paradigm shift is possible.

SUMMARY OF THE INVENTION

According to a first aspect of the invention there is provided a hair styling appliance for dual supply voltage operation comprising: a body having at least one arm bearing a hair styling heater, wherein said hair styling heater comprises one or more heater electrodes for heating said hair styling heater; a first power input connectable to a battery power source; and a second power input connectable to a mains powered source; wherein said first power input and said second power input are each coupled to at least one of said one or more heater electrodes, and wherein said hair styling appliance is useable for styling when coupled to said mains powered source and when coupled to said battery power source.

The hair styling appliance can be powered from two sources: a battery power source and a mains powered source connected via a first power input and a second power input respectively. In embodiments the mains powered source may provide a DC voltage of less than 100V to said second power input. More preferably the mains powered source may be configured to provide a DC voltage of approximately 24V to the second power input. Both power sources can be used to power the heater enabling use, by a user, when the styling appliance is coupled to the mains powered source and when the styling appliance is coupled to the battery power source. This means that a user can style hair from both a mains powered source and battery power source making the hair styling apparatus versatile.

In embodiments, the heater may comprise two heater electrodes in which the first power input is coupled to one of the two heater electrodes and the second power input is coupled the other of the two heater electrodes such that each power input, and therefore connected power source, is powering a separate heater electrode. In this way, each heater electrode may be optimised to the source it is powered from. This may also enable the hair styling heater to be heated by both said heater electrodes at the same time. The hair styling heater may then be simultaneously heatable with both of the two heater electrodes operating at the same time—one is powered by the battery power source and the other by the mains powered source at the same time.

When connected to both power sources, powering both electrodes simultaneously may provide a boost the rate of heating, providing a faster heat up time over using just one power source. During use and after initial heat up, driving both electrodes may provide a further boost period of increased heat. This may be particularly useful in cases where a user places a large quantity of hair across the heater leading to momentary cooling of the heater or where a section of hair is proving particularly tricky to style.

The heater electrodes may have different resistances such that each can be optimised to the power source that powers that particular heater electrode. In embodiments the battery powered electrode may be driven from batteries providing a total voltage lower than an external power source. As such, the battery powered electrode may be formed to have a lower resistance that the other electrode powered by a higher voltage external powered source. The resistances may be such that the power consumed by the heater elements are roughly the same in spite of the different supply voltages.

In some embodiments, one electrode may provide two different resistances by tapping oft one electrode at a particular distance along its track. This means that a lower resistance element simplify the layout of electrodes on the heater. Selection of a particular resistance may be dependent on which power source is connected and be controlled by the controller.

The hair styling appliance may further comprise a controller coupled to the power inputs and the one or more heater electrodes. This controller may be used to control the one or more heater electrodes and may include switching on and off of each heater electrode.

Some embodiments may further include one or more temperature sensors coupled to the hair styling heater. In such embodiments the controller may further monitor the temperature of the hair styling heater and activate one or both of the heater electrodes depending on the connected source and any adjustment to the temperature required. Examples of temperature sensors include thermistors, in particular printed thermistors.

The hair styling heater in the hair styling appliance may comprise a plurality of laterally-spaced zones, each having the one or more heater electrodes. In such an embodiment each zone may be powered by both power sources, with power delivery to each zone zone controllable independently. This may include, for example, monitoring and managing the temperature of each zone independently.

In some embodiments the hair styling appliance may comprise two arms moveable between a closed position in which the hair styling heater of the first arm is adjacent a hair styling heater of the second arm and an open position in which the hair styling heater of each arm are spaced apart. In such an embodiment one or both of the hair styling heaters may comprise the one or more heater electrodes. Such an embodiment may be used for hair straightening when used with plate-like hair styling heaters.

The hair styling heater may comprise: a metal sheet or plate; an oxide layer comprising an oxide of the metal on a surface of the metal sheet or plate; and the one or more heater electrodes over the oxide layer. In such an embodiment the oxide layer provides electric insulation between the metal sheet or plate and electrode(s).

In embodiments, when connected to the mains powered source, the mains powered source may be used to charge the battery power source. In some embodiments charging may only be permitted when the styling appliance is not being used for styling (i.e. heating the styling heaters). In other embodiments charging and styling may be possible at the same time subject to the mains powered source being able to deliver sufficient current at the required operating and charging voltage.

The hair styling appliance may further include the mains powered source the battery power source, i.e. it may be provided for example as a battery pack constructed to fit within one of the handles of the styling appliance. Such a battery source may be configured to provide a voltage in the range of 7 to 15V DC. In some preferred embodiments the battery power source is configured to provide a voltage of approximately 11V. Such a battery power source may comprise three battery cells, each providing 3.7V for example.

The battery power source may be user removeable from said hair styling appliance, and may be in the form of a battery power pack, or individual battery cells. In either case, the fact that the battery source is removeable by a user means that the battery source is readily interchangeable. A user may for example have more than one battery power pack that can easily be swapped when it runs flat.

In other embodiments however, the battery power source may be user non-replaceable. Such embodiments may allow for further design freedom through the use of different battery configurations, enable a better weight distribution in the appliance and may allow for more aesthetically pleasing hair styling apparatus designs.

The hair styling appliance may further include the mains powered source as, for example, an external power adapter with a mains AC input and a further connector couplable to the second power input. Such a power adapter may operate from one or multiple AC voltages such as 230V and 110V AC, in both cases providing the necessary DC output voltage for connecting to the second power input on the hair styling appliance.

According to a second aspect of the invention that is provided a method of controlling a hair styling appliance according to the above aspect, comprising heating said one of said two heater electrodes powered by said battery power source and said another of said two heater electrodes powered by said mains powered source during one or both of a boost function and a start-up function. Driving both electrodes, each from a different power source, provides a faster heat up time during start-up over using just one power source. Furthermore, during use and after initial heat up, driving both electrodes may provide a 'boost' period of increased heat generation. This may be particularly useful in cases where a user places a large quantity of hair across the heater leading to momentary cooling of the heater or where a section of hair is proving tricky to style.

According to a further aspect of the invention there is provided a hair styling appliance configured to implement the method according to the second aspect of the invention.

According to a further aspect of the invention there is provided a hair styling appliance for dual supply voltage operation comprising: a body having at least one arm bearing a hair styling heater, a battery power supply to provide a DC voltage to power said hair styling heater; and an external power input connectable to a mains powered source to power said hair styling heater, wherein said hair styling heater comprises: a metal sheet or plate; an oxide layer comprising an oxide of said metal on a surface of said metal sheet or plate; and at least two heater electrodes over said oxide layer, wherein one of said two heater electrodes is coupled to said DC battery power supply and the other of said two heater electrodes is coupled to said external power input.

This external power input may be a power adapter for example that can convert mains AC voltage into a DC power source. Providing two heater elements enables each to be driven separately, for example, one being driven when connected to battery, the other when connected to the external power. In embodiments both electrodes may be driven simultaneously when connected to both power sources to provide a power boost leading to a faster heat up time. Furthermore, during use and after initial heat up, driving both electrodes may provide a boost period of increased heat to be generated. This may be particularly useful in cases where a user places a large quantity of hair across the heater leading to momentary cooling of the heater.

In embodiments the battery power supply may provide around 11V (7 to 15V for example) and the external power supply, coupled to the external power input may provide a higher voltage, for example 24V derived from a 230V or 110V AC mains source. With different voltage inputs, the heater electrode coupled to the DC battery power supply may then have a resistance less than the other of the two heater electrodes coupled to the external power input such that the electrode power outputs on the heaters are approximately similar.

According to a further aspect of the invention there is therefore provided a hair styling appliance comprising a body having at least one arm bearing a hair styling heater, wherein said hair styling appliance comprises a low voltage power supply to provide a voltage of less than 100v to power said hair styling heater; and wherein said hair styling heater comprises: a metal sheet or plate; an oxide layer comprising an oxide of said metal on a surface of said metal sheet or plate; and a heater electrode over said oxide layer, wherein said heater electrode is coupled to said low voltage power supply.

In any of the above aspects of the invention preferred embodiments the oxide layer comprises a layer of plasma electrolytic oxide (PEO), preferably less than 200 μm, 100 μm, 50 μm or 25 μm in thickness, and the heater electrode comprises a printed conductive ink electrode, in particular comprising an inorganic, ceramic frit, and having a similar thickness range.

The PEO layer whilst being smooth and durable on a microscopic scale is relatively rough on a microscopic scale. On this microscopic scale the holes and crevices could be considered a problem, but at low voltages (less than 100V) the dielectric strength of the material is nonetheless sufficient. Moreover the rough surface is a substantial advantage in that it Facilitates keying in of a subsequent layer, in embodiments the electrode layer. (For convenience reference is made to an electrode layer although in preferred embodiments the electrode layer comprises an electrode deposited from conductive ink or the like).

Where the electrode ink comprises a frit, in particular a glass (or ceramic) frit, it is believed that the curing process of the conductive ink raises the temperature of the glass (or ceramic) sufficiently for it to flow or slump (i.e. partially merge) somewhat into the holes and crevices, thus providing a surprising increase in the dielectric strength of the oxide layer. In other embodiments however, a passivation/planarisation layer, for example organic passivation/planarisation layer, in embodiments comprising polyamide, is included between the oxide layer and the electrode layer, Such variants again apply to all aspects of the invention.

In preferred embodiments the metal of the metal sheet or plate comprises aluminium or copper. The differential thermal expansion of aluminium as compared with the overlying layers would typically be expected to cause delamination. However but where these layers are relatively thin, and in particular where the oxide layer is formed of PEO, such delamination is not observed and experiments have shown that it is almost impossible to cause delamination. The conductive material in the conductive ink may, for example, comprise silver and/or carbon or other conductive material; and the precise conductor does not appear to be important. In embodiments the electrode is screen printed onto the oxide (or other) layer.

Embodiments of the invention, as described above, provide a combination of features which define a new region of parameter space in which it is possible to construct a low voltage, for example cordless, battery-operated hair styling appliance whilst retaining rapid heating and good temperature and thermal transient control. The skilled person will appreciate that the precise combination of thicknesses, heater voltages, resistance values and the like may be optimised by experiment in the context of a particular appliance given the size/thermal mass of the heating plate, final temperature and optionally other information relating to the operational context.

In embodiments the hair styling heater includes at least one temperature sensor on the oxide layer, either a discrete component or, more preferably, a printed thermistor. As described further later, however, the low voltage operation of the appliance facilitates using the heated electrode itself to sense temperature by means of its variation in resistance with temperature.

Optionally embodiments of the hair styling appliance may also be provided with an oxide layer, in particular a PEO layer on the face of the heater towards the hair. Optionally a protective coating such as silicon dioxide may be applied over this layer; this may incorporate silicone oil into the structure, for example in the range 1-10% by weight, to provide reduced friction for hair passing over the heater. (This may be achieved by spraying a precursor to the protective coating onto the heater in combination with silicone oil).

The skilled person will therefore appreciate that in embodiments the low voltage hair styling appliance comprises a hair styling heater which has a unitary or integrally formed structure, comprising the metal heater sheet or plate itself, the layer of insulating oxide, the heater electrode and, in embodiments, the temperature sensor.

One advantage of embodiments of the invention is that the heater plate may be relatively thin so that the heater heats up very quickly; this is also power-efficient. However one drawback of a thin heater plate is that there is reduced lateral thermal conductivity so that there may be local cooling of one region of the heater plate with respect to another. One approach to address this is to provide one or more laterally spaced heater-zones for the heater sheet or plate, each with a separately powerable electrode (the electrodes may, nonetheless, have one or more connections in common). In embodiments a temperature sensor is also provided for each zone, but this is not essential as the electrodes themselves may be employed for temperature sensing using their resistance. The laterally spaced zones may be distributed along a length (longer dimension) of the heater plate or and/or a width of the heater plate; there may be 2, 3 or more zones in one or both of these perpendicular directions.

The use of zones is not restricted to thin (say less than 1 mm) heater plates and may also be employed with thicker plates (thickness in the range 1-4 mm). For a flat heater plate a thickness of 2-3 mm can provide a reasonable trade off between lateral thermal conductivity and thermal capacity/heating time (particularly for aluminium; the preferred range for copper may be less, for example 1-3 mm).

The use of a thin heater plate, for example less than 1 mm or less than 0.8 mm thickness in combination with the above described construction facilitates manufacture of a heater plate with a curved surface: the heater plate can be fabricated flat, the oxide and electrode layers added, and then the heater plate bent into shape. It will be appreciated that it is difficult to screen print onto the inside of a tube, and embodiments of the above described system facilitate the fabrication of a thin heater plate which can be bent and which does not delaminate when bent. This facilitates the fabrication of, for example, a hair curling hair styling appliance. (As previously mentioned, in embodiments the thickness of the oxide layer is in the range 5-15 μm and the thickness of the heater electrodes is in the range 2-20 μm).

The low voltage power supply may be a mains powered power supply to provide, for example, a 12 volt or 24 volt output or a lithium ion battery may be employed, for example to provide a voltage of 12v or less. In embodiments a heater electrode has a resistance matched to the power supply voltage such that the electrical power dissipated is in the range 50-200 watts.

Embodiments of the hair styling appliance include a circuit configured to sense a temperature of the metal sheet or plate from a resistance of the heater electrode (or, in a system with multiple zones, to sense a temperature of each zone correspondingly).

In other embodiments multiple temperature sensors may be employed at multiple different lateral positions on the heater plate to detect local cooling by hair. Using the resistance of the electrode for temperature sensing removes the need for an additional manufacturing step to attach one or more thermistors; temperature sensing using one or more printed tracks is facilitated by the low electrode voltage. The temperature sensing circuit may be incorporated in a control loop controlling power applied to the heater electrode(s) to regulate the temperature of operation to operating temperature for example in a range 140-200° C., in embodiments around 160° C.

Embodiments of the heater will generally include a thermal fuse to remove power from the electrode in the event of overheating; this may comprise a bimetallic strip, wax pellet thermostat or the like. However, preferably the appliance also includes an electronic shut down system, preferably fabricated in hardware rather than software (or reduced failure modes) and preferably connected in parallel with the low voltage power supply across an electrode. The power supply to the electrode may then include a guard transistor, for example a power MOSFET or IGBT, connected in series between the low voltage power source and the heater electrode, controlled by the electronic shutdown system. The electronic shut down system may monitor one or more parameters of the hair styling appliance including, but not limited to: heater temperature, power control device operational status (whether the power supply is switching off correctly), current drawn by an electrode and the like, and in response control the guard transistor to remove power from one, more or all of the electrodes on detection of a potential fault. Such an electronic shut down system is applicable to any of the above aspects of the invention.

As an additional or alternative safety feature optionally a portion of a track of a heater electrode may be provided with a neck so as to form an integral fuse where part of the electrode track itself forms a fuse. This approach is particularly suited to low voltage operation because the track resistance is low and the currents relatively high and thus such a neck can operate as current operated fuse, in particular because when the temperature increases beyond the threshold there is a thermal runaway effect at the neck which blows the fuse.

Embodiments of a hair styling appliance may have a heater configured for use with both a low voltage power supply, for example a battery, and a mains power supply. In this case two heat electrodes may be provided one for each power source. Further because of the enhanced dielectric strength required for mains operation, the oxide layer should be substantially thicker than where the heater is solely for low voltage use.

In a related aspect the invention provides a heater for a low-voltage hair styling appliance, the heater comprising: a metal sheet or plate; an oxide layer comprising an oxide of said metal on a surface of said metal sheet or plate; and a heater electrode over said oxide layer; wherein said oxide layer comprises a layer of plasma electrolytic oxide.

Any or all of the above described features of the hair styling appliance may be incorporated into the above described heater aspect of the invention.

There is further provided a method of manufacturing a heater for a low-voltage hair styling appliance, the method comprising: providing a metal sheet or plate; depositing a layer of plasma electrolytic oxide onto a surface of said metal sheet or plate; and fabricating a heater electrode over said oxide layer.

In preferred embodiments the printing employs an ink comprising a ceramic, in particular glass frit. A curved heater surface may be fabricated by being the metal sheet or plate after fabricating the heater electrode.

A hair styling appliance may be fabricated including the manufactured heater.

We also describe a method of manufacturing a hair styling heater comprising placing an unbaked ceramic, such as aluminium oxide, onto a substrate and baking the ceramic on the substrate such that the ceramic and substrate bond together. Such a substrate may be, for example, the heater plate used for styling.

The ceramic may be aluminium oxide for example and the substrate may be aluminium. Flat hair styling heaters may be formed by such a process. The ceramic may also be shaped into other arrangements prior to baking, such as curved shapes, tubes or cylinders.

BRIEF DESCRIPTION OF THE DRAWINGS

These and other aspects of the invention will now be further described, by way of example only, with reference to the accompanying figures in which.

DETAILED DESCRIPTION OF THE PREFERRED EMBODIMENTS

Figure 1:
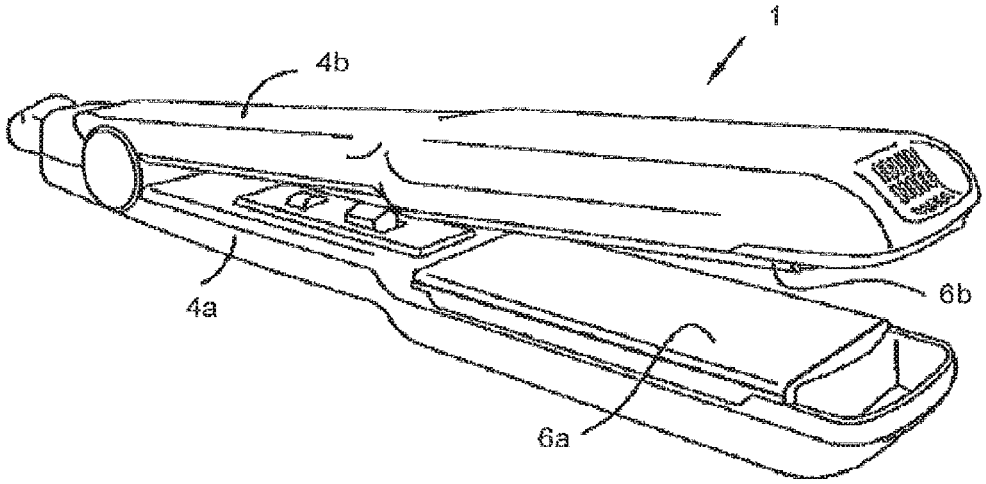
Figure 1 (prior art)
FIG. 1 shows a first example of a hair straightener in a context of which embodiments of the invention may be employed.
Figure 2:
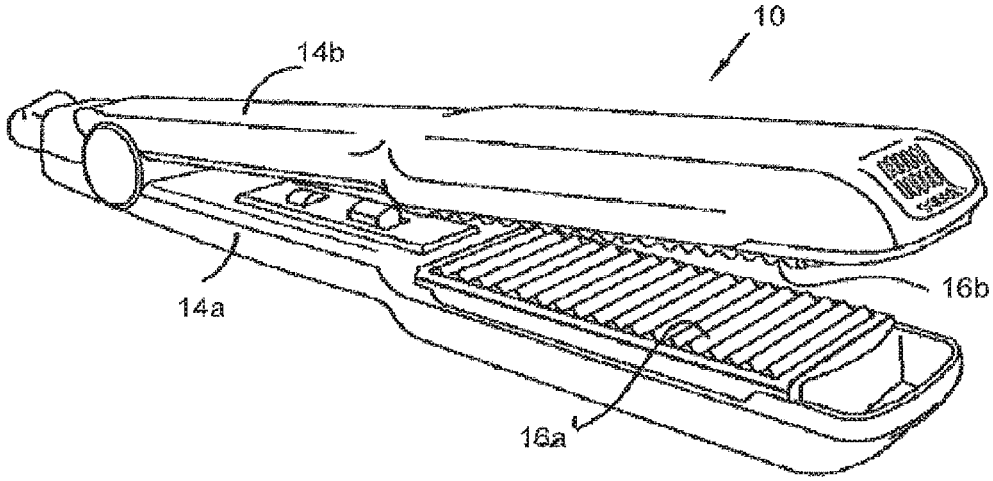
Figure 2 (prior art)
FIG. 2 shows an example of a crimping iron in a context of which embodiments of the invention may be employed.
Figure 3A:
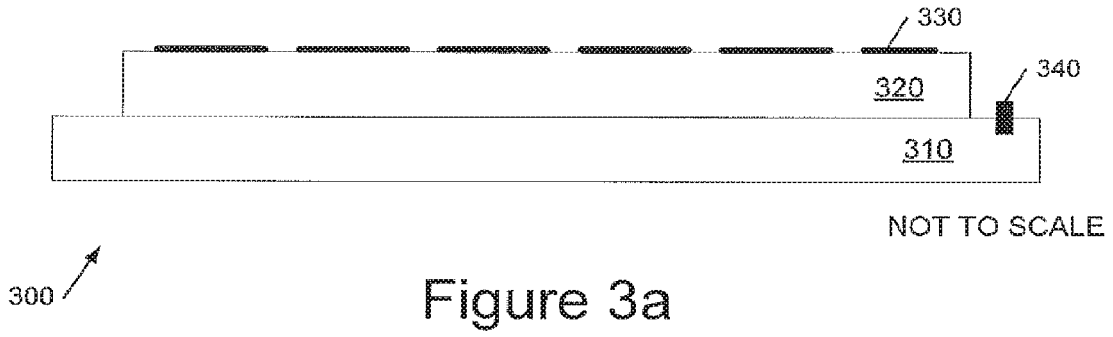
FIGS. 3*a* and 3*b* show, respectfully, cross-sectional views of embodiments of a heater for a hair straightener and a hair curler according to the invention.

Referring to FIG. 3*a*, this shows a hair styling heater 300 comprising an aluminium heater plate 310 of thickness of order 1 mm, bearing a plasma electrolytic oxide (PEO) coating of aluminium oxide 320 of thickness less than 100 μm, for example in the range 5-15 μm.

In a suitable plasma electrolytic oxidation process the aluminium plate 310 is connected to a high voltage (in embodiments≥than 1 KV or ≥10 KV, for example approximately 25 KV) and immersed in a bath of electrolyte to grow an outside coating which is macroscopically smooth but microscopically rough. A suitable process is available from Keronite International Limited, Cambridge, UK.

Although shown on just one surface of the heater, in embodiments the PEO coating is provided on both surfaces of the heater plate and, on the surface facing the hair (the lower surface in FIG. 3*a*) coloured with a lower silicon dioxide or similar material. In embodiments the coating comprises CeraSOL™) centrifuged with 6% silicone oil and provided to a spray head to coat the PEO, afterwards being baked hard. The inclusion of silicone oil helps to reduce friction with the hair.

The various interstices, cracks and defects of the PEO layer at the microscopic level help to key in an electrode layer which is deposited on top of PEO layer 320. However alternatively, but less preferably, a polyamide planarisation layer is provided over layer 320 prior to applying the electrode.

Preferably conductive ink is screen printed onto the surface of PEO layer 320 in a desired electrode pattern 330. A preferred conductive ink is an inorganic ink comprising a dispersion of conducting, metallic for example silver, particles of sizes 100 μm down to 1 μm or less in combination with a glass or ceramic powder or frit, and a binder (which is typically organic). A curing process far such an ink might have 3 temperature stages, a thermostat, for example around 100° C. to drive off the solvent/binder a second at perhaps 350° C., and a third at, perhaps of order 500° C. (or more) for one to a few minutes. This latter stage softens the glass frit which it is believed settles into the cracks and other defects in the PEO layer, binding the printed electrodes to this layer. For a thin PEO layer the resistance to the layer may be of order of 10 s of kilohms and this layer can provide sufficient dielectric strength of voltages of less than 100v.

Figure 3B:
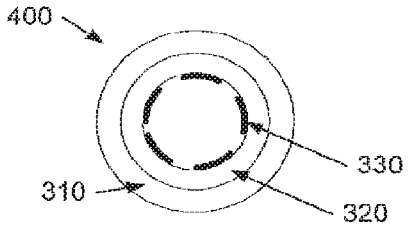

A heater construction of this type has been found to be exceptionally durable and the heater may be bent in to a desired shape after printing (and clearing) of the ink: although the electrode resistance can change during such a process, it changes in a predictable manner. Thus this enables, for example, a 'make, print, bend' manufacturing process for a curved heater plate for a hair curler (FIG. 3*b*). The resistance to delamination is enhanced by using a relatively thin electrode layer, for example less than 100 μm, 50 μm or 20 μm.

The heater may be provided with a thermistor 340 for temperature sensing. This may be a separate component but, preferably, the thermistor is a printed device, for example printed from carbon ink which has a relatively high change in resistance with temperature, then optionally laser trimmed to a desired resistance value. This provides a heater assembly which is integrally formed as a single unit, having many advantages in terms of cost, ease of manufacture and performance.

Figure 4:
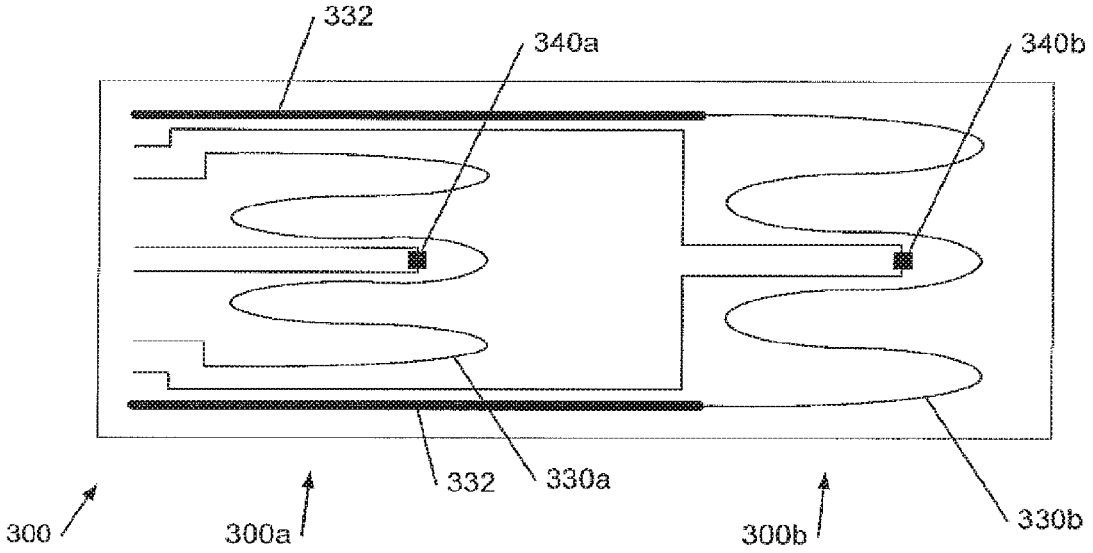
FIG. 4 shows a plan view of an embodiment of a hair styling heater according to an aspect of the invention.

Depending upon the thickness of heater plate 310, lateral conductivity within the plate may not be sufficient to reduce local cooling by hair to a desirable level. Thus in embodiments, as illustrated in FIG. 4, the heater plate 300 may be provided with a plurality of separately controllable heating zones 300*a, b*, each with a respective electrode 330*a, b* and thermistor 340*a, b*. Connections to these are brought out, for convenience, to one edge of the heater plate; a broadened track region 332 is provided for the electrode further from the connection point to reduce heating in the connection path. Each of the electrodes is provided with a separate control loop controlled by the temperature sensed by the respective thermistor. In embodiments more than 3 zones may be provided.

Figure 5:
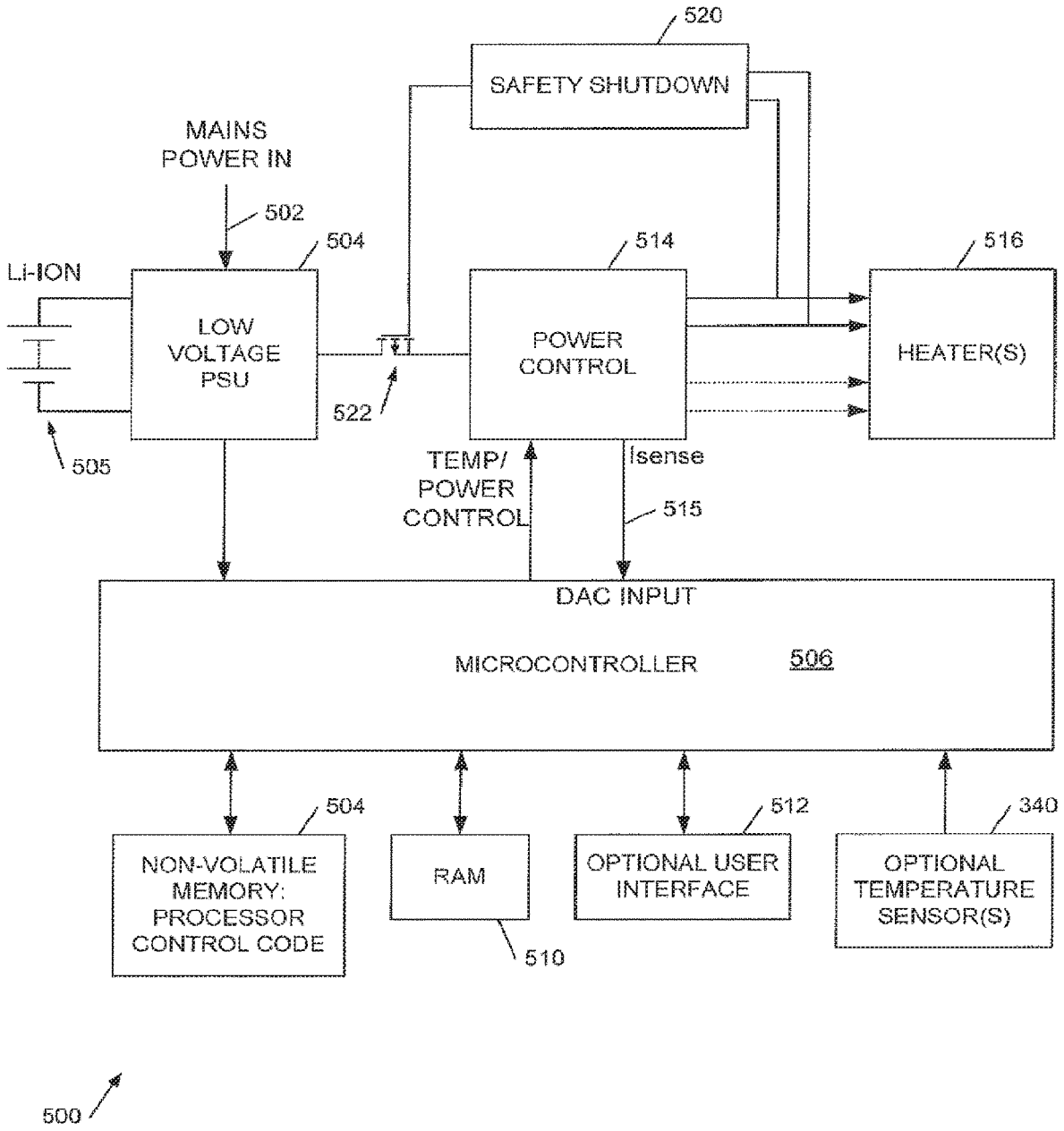
FIG. 5 shows a schematic block diagram of a hair styling appliance incorporating a hair styling heater of the type illustrated in FIGS. 3 and 4.

FIG. 5 shows a block diagram of a power/control system 500 for a hair styling appliance incorporating heater 300. The system comprises a low voltage power supply 504 deriving power from a 12v lithium ion battery 505 and/or a mains power supply input 502, which is used to charge the battery 505. Power supply 504 may be configured to provide approximately 100 watts per heater; the heater resistance when hot may be selected accordingly—for example at 12v a current in the range 5-10 amps may be delivered to a heater with a resistance in the range 1-2 ohms. The resistance may be scaled accordingly as the design voltage increases or decreases (changing as the inverse square of the voltage).

Power from power supply 504 is provided to a power control module 514, which in turn powers the one or more heaters 516. Power control module 514 may employ one or more power semiconductor switching devices to provide pulse with modulation control of the (DC) voltage from power supply 504 to heaters 516. Thus a high percentage on-time duty cycle may be employed during the initial, heating phase and afterwards the on-time duty cycle may be reduced and controlled to control the temperature(s) of the heaters 516.

Power from power supply 504 is also provided to a microcontroller 506 coupled to non-volatile memory 508 storing processor control code for a temperature control algorithm, and to RAM 510. The skilled person will appreciate that any of a wide range of different control algorithms may be employed including, but not limited to, on-off control and proportional control. Optionally the control loop may include a feed-forward element responsive to a further input parameter relating to the hair styling appliance, for example to use the operation of the apparatus to improve the temperature control. An optional user interface 512 is also coupled to microcontroller 506, for example to provide one or more user controls and/or output indications such as a light or audible alert. The output(s) may be employed to indicate, for example, when the temperature of the heating plate has reached an operating temperature, for example in a region 140° C.-185° C.

Microcontroller 506 is also coupled to one or more optional temperature sensors such as thermistors 340. However, as previously mentioned, the temperature of a heating element may be sensed from its resistance and thus embodiments of the system include a current sense input to microcontroller 506 sensing the current provided to a heater, for example via a current-sense resistor connected in series with the electrode. A predetermined calibration of resistance against temperature for an electrode may be stored in non-volatile memory 504 and in this way the printed track may be employed as a temperature sensor.

Figure 6:
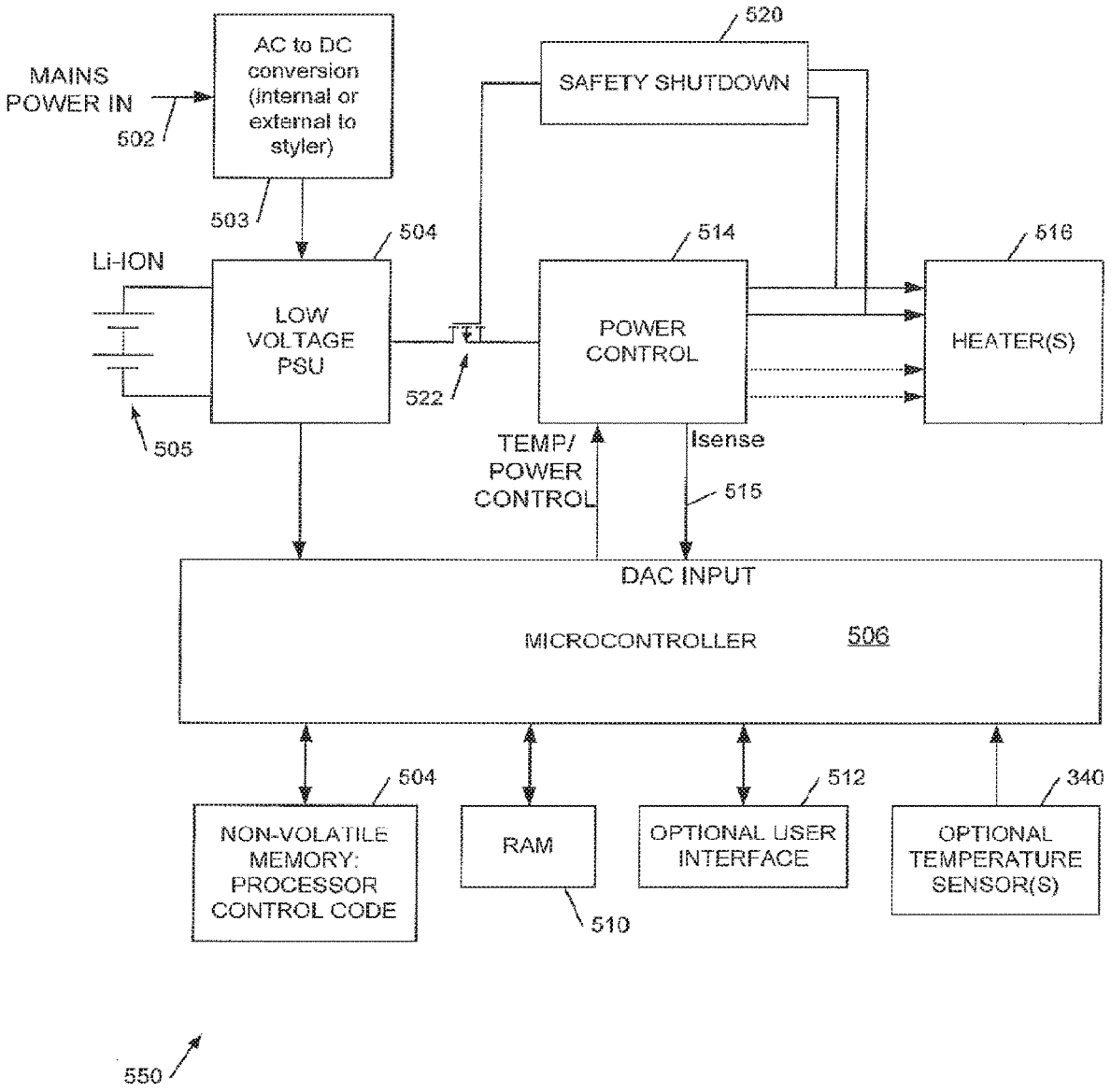
FIG. 6 shows a further schematic block diagram of a hair styling appliance incorporating a different power supply arrangement to that of FIG. 5.

FIG. 6 shows a variant of the power/control system 500 described and shown with reference to FIG. 5. In the embodiment in FIG. 6, an external AC to DC power supply adapter is used instead to provide a mains powered source.

As previously mentioned a heater may incorporate a thermal fuse, for example a bimetallic strip or similar on the rear of the heater, to automatically disconnect a power supply to an electrode if the heater temperature increases above a threshold for greater than a permitted duration. Additionally or alternatively, however, the system incorporates one or more safety shut down circuits 520 coupled to the one or more heater electrodes and/or temperature sensors 340 to monitor the heater temperature and electronically shut down the power supply to the heater should overheating be detected. Overheating may comprise exceeding a threshold temperature or exceeding a threshold temperature for greater than a permitted duration or some more complex function such as integral of temperature over time. Preferably the safety shut down circuit is implemented in hardware rather than in software on the microcontroller, to reduce possible failure modes. In embodiments safety shut down circuit 520 controls a guard transistor 522, as illustrated a power MOSFET, which removes power from the power control block on detection of a potential fault. Guards transistor 522 may be provided either before or after power control block 514. In normal operation this device is always on; the device may be selected such that when power is removed from the transistor it switches off, thus failing safe, for example by employing an enhancement—mode device. Such control and safety shut down is applicable to all the embodiments described herein.

In embodiments low voltage power supply 504 may support both 110v and 230v mains input and may be a switch mode power supply. As described with reference to FIG. 6, other embodiments may use an external power supply which may itself support 110V or 230V mains input. This external power supply may be used to provide galvanic isolation, step down the AC voltage and/or provide a DC voltage, such as 24V to the hair styling appliance.

In variants of the above described appliances the heater may be configured for both low voltage and mains voltage operation, by increasing the thickness of the oxide layer. The option of a mains powered heater can provide some advantages for the user even if reducing some of the benefits of the low voltage heater construction. In another variant rather than employing the electrode itself for temperature sensing, a separate electrode track or spur from an electrode may be employed for this purpose, thus using the printed ink as the temperature sensing element.

FIGS. 7 to 10 show alternative embodiments of the hair styling appliance with varying power supply, heater electrode and zone configurations. These variants may also be applied the heater embodiments shown in the previously described embodiments. Such features may include, but are not limited to, use of a metal sheet or plate, an oxide layer, the use of conductive ink electrodes.

Generally speaking, the different embodiments 560, 570, 580, 590 each have an external power supply 561, 571, 581, 591 respectively to deliver 24V DC (for example) to the hair styling apparatus. The embodiments may also use differing numbers of cells in the battery packs. Selecting the number of cells to use is a trade-off between the weight and size of the styling appliance and the styling performance and battery life.

In the embodiments shown in FIGS. 7 to 10 the charge control 1 power path block 562, 572, 582, 592 controls delivery of power from the battery and external supply, and charging of the battery 564, 574, 584, 594. System control block 563, 673, 583, 593 generally includes many of the blocks of FIG. 5 or 6 such as power control and the processor electrodes including microcontroller and memory.

Figure 7:
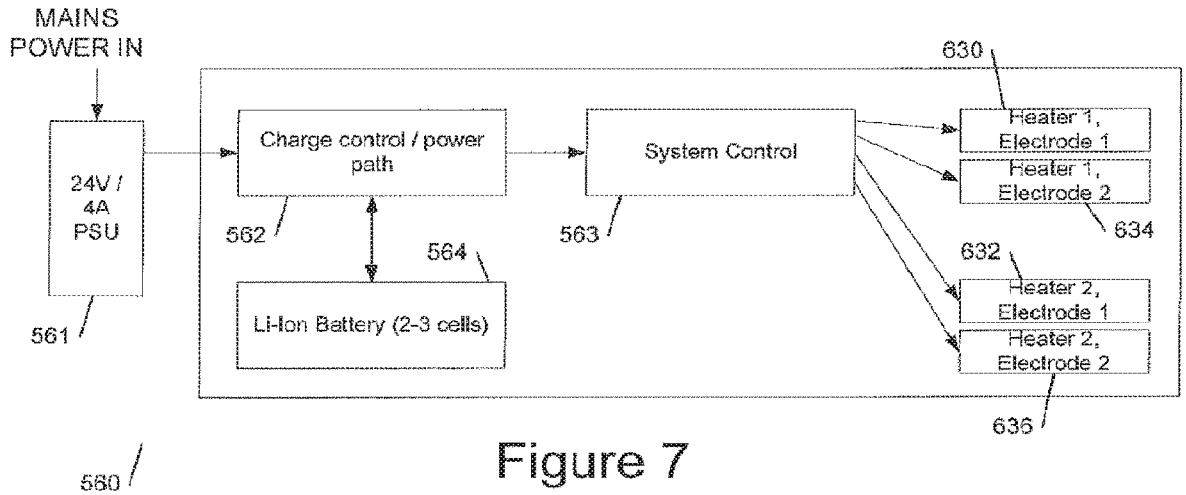
FIG. 7 shows one embodiment of the hair styling appliance capable of being powered by a mains powered source and battery power, with multiple heater electrodes and zones.
Figure 12:
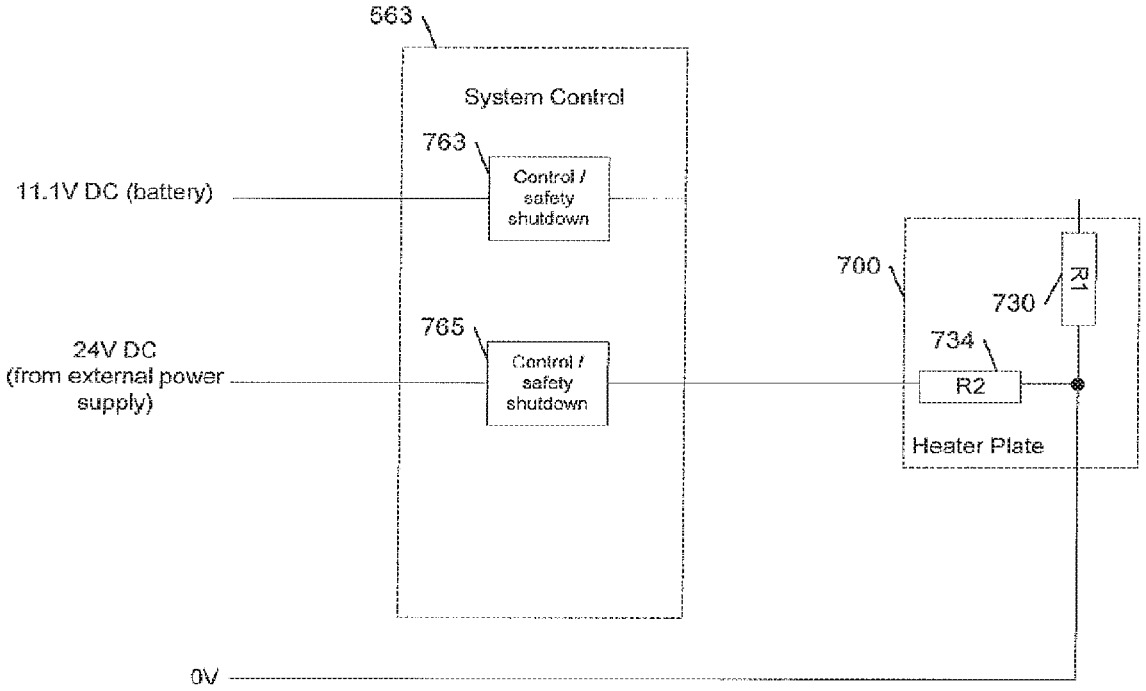
FIG. 12 shows an example circuit for powering the dual drive heater at FIG. 7.

Referring to FIG. 7, this embodiment shows a variant of the hair styling apparatus in a 'dual drive' configuration, further details of which are shown in FIG. 12. In this embodiment each heater has two electrodes 630, 634, and 632, 636. Electrode one 630 is powered by the battery pack 564 and electrode two 634 by external 24V supply 561. In this configuration, a two or three cell battery pack is used, using cells with a nominal voltage of, for example, 3.7V, supplying a total voltage of between 7.4V and 11.1V. Lithium Ion or Lithium Polymer batteries are particularly useful due to their high power density.

Such a battery pack may be removeable or not removeable. In this embodiment and by way of example only, the battery pack may not be removable reducing design constraints and allowing a more compact and/or aesthetically pleasing design to be used.

Figure 11:
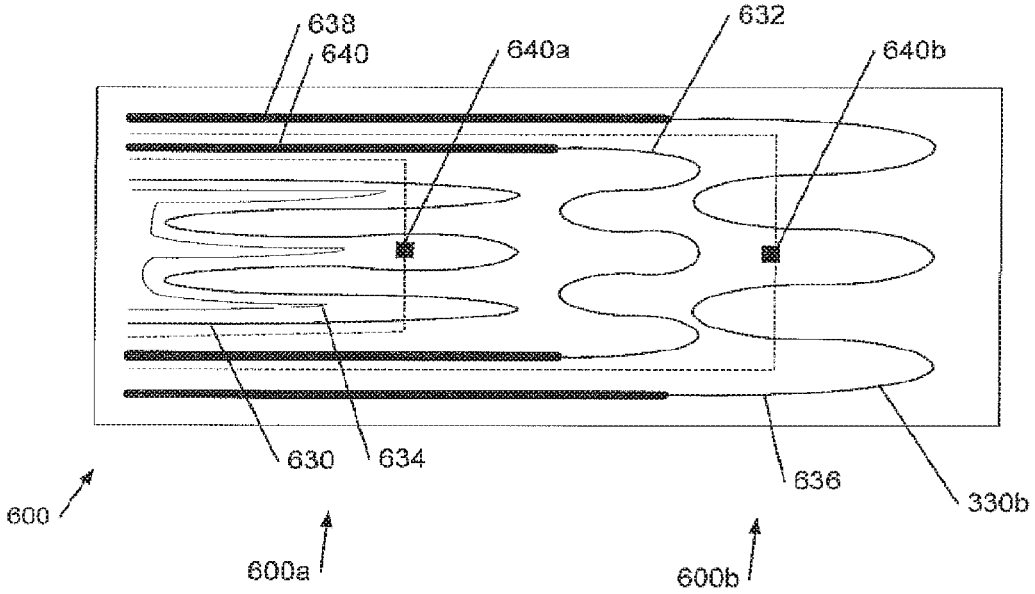
FIG. 11 shows a plan view of an alternative embodiment of the hair styling heater of FIG. 4.

Heater one and two in FIG. 7 refer to two different thermally regulated zones and may be two different zones on the same heater plate as shown in FIG. 11, or two different heater plates, one on each arm of a styling appliance. FIG. 11 adapts the heater plate of FIG. 4 to include two further heater electrodes. Heater electrodes 630 and 634 provide a first heating zone with thermal sensing provided by thermistor 64*a*. In this first heating zone, heater electrode 630 is powered by the battery pack 564 of FIG. 7 and heater electrode 634 is powered by the external supply 561. Heater electrodes 632 and 636 provide a second heating zone with thermal sensing provided by thermistor 640*b*. In this second heating zone, heater electrode 632 is powered by battery pack 564 of FIG. 7 and heater electrode 646 is powered by the external supply 561. It will be appreciated that the arrangement of FIGS. 7 and 11 may be readily adapted to provide a styling apparatus with more than two thermally regulated zones, for example with dual zones on each heating plate.

Further details of the heater electrode are shown in FIG. 12. In this arrangement, the heater plate 700 includes two heater electrodes formed by resistive electrodes R1 (730) and R2 (734). R1 provides heater electrode one 630 of the dual drive arrangement and is powered by the battery source. R2 provides heater electrode two 634 of the dual drive arrangement and is powered by the external power supply. As previously explained with reference to FIG. 5, the electrode resistances R1 and R2 may be scaled accordingly as the design voltage increases or decreases (changing as the inverse square of the voltage). In FIG. 12, one or both of the heater electrodes may be enabled and shutdown by a control/safety shutdown circuits 763, 765.

Returning now to FIG. 7, in a first mode of operation, the styling appliance may operate on battery power only, being powered by the battery pack 564. When running from battery power, system control block 563 enables electrode one (630, 632, 730) to be powered on each heater. In the example in FIG. 12, the battery power source is a 3-cell battery pack providing 11.1V (each cell provides 3.7V) and resistive electrode R1 is 2.25 Ohms yielding a power dissipation of around 50W. It will be appreciated that these values are approximate and other values are possible.

In a second mode of operation, the styling appliance is powered by external power supply 561. In this mode, system control block 563 enables electrode two (634, 636, 734) to be driven on each heater. The battery pack 564 may also charged. It will be appreciated however that in variants the battery may only be charged when no electrodes are being heated. In the example in FIG. 12, a mains AC to DC power supply delivers 24V DC to the hair styling apparatus and resistive electrode R2 is 11.65 Ohms yielding a power dissipation of around 50W. It will be appreciated that these values are approximate and other values are possible.

From the above it will be appreciated that in this embodiment the electrode resistances are set such that the power output from each electrode is generally similar given a similar heating effect from either power source. Each different heater electrode may have a resistance matched to the supply voltage such that the electrical power dissipated is in the range 50-200 watts. Matching the power outputs of each electrode is however non-essential, and an appliance may be implemented to provide a lower power output from battery, or a higher power output when mains powered. It will be appreciated however that providing a generally similar power output from both power sources provides the user with a consistent styling experience whether running from batter or mains power.

In a third mode of operation, the styling appliance is again connected to external power supply 561, but both heater electrodes may be turned on simultaneously. This 'dual drive' mode boosts the power available and improves the heating of the heater plate the electrode is mounted on. This is particularly useful for reducing the time to heat up the heater plate from cold and may also be useful to provide a 'power boost' to increase the plate temperature if a section of hair is proving particularly challenging to straighten. In some embodiments this power boost may be limited to a short duration of time or be dependent on the charge level in the battery pack. Such dual drive and power/heating boost may be controlled by the system control and charge control blocks.

Figure 8:
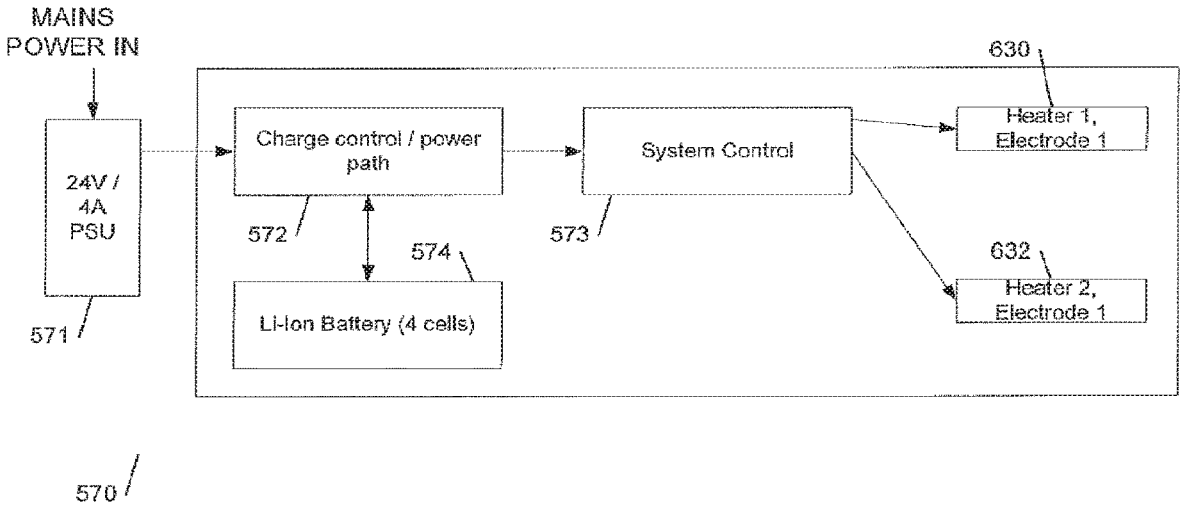
FIG. 8 shows a further embodiment to that of FIG. 7 with a different arrangement of heater electrodes and zones.

FIG. 8 shows a further embodiment to that of FIG. 7 with a different arrangement of heater electrodes and zones. In this configuration the battery pack 574 is increased to include four cells providing more energy and a higher supply voltage. In this variant a single heater electrode 630, 632 is provided for each heater/thermal zone. In a first mode of operation, the styling appliance may operate on battery power only, being powered by the battery pack 574. In a second mode of operation, the styling appliance operates on the external power supply 571. In this second mode the battery pack may also be charged, either simultaneously with powering the heater electrode or separately, when no power is delivered to the heater electrode. In both modes, the same heater electrode is powered.

Figure 9:
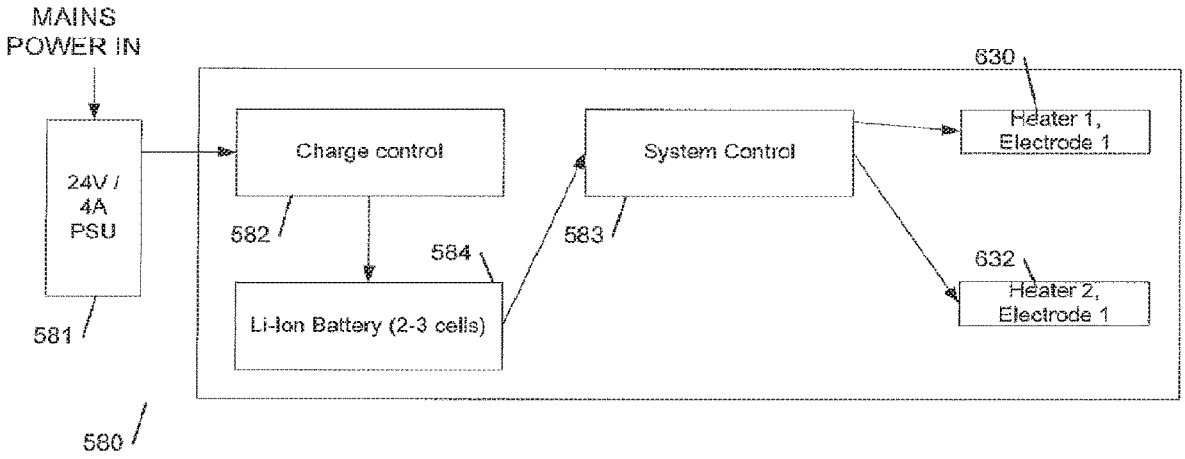
FIG. 9 shows a further embodiment of the hair styling appliance to that of FIGS. 7 and 8.

FIG. 9 shows a further embodiment of the hair styling appliance to that of FIGS. 7 and 8. In this variant, termed "charge through" a single heater electrode 630, 632 is provided for each heater/thermal zone as used in FIG. 8. In this variant, the heater electrode is powered only from the battery pack 584 and the external power supply used to charge the battery pack only. This means that the external power supply is indirectly coupled to the heater electrodes via the battery pack. The charge control block 582 may allow the battery back to be charged during styling to allow for extended use of the styling appliance.

Figure 10:
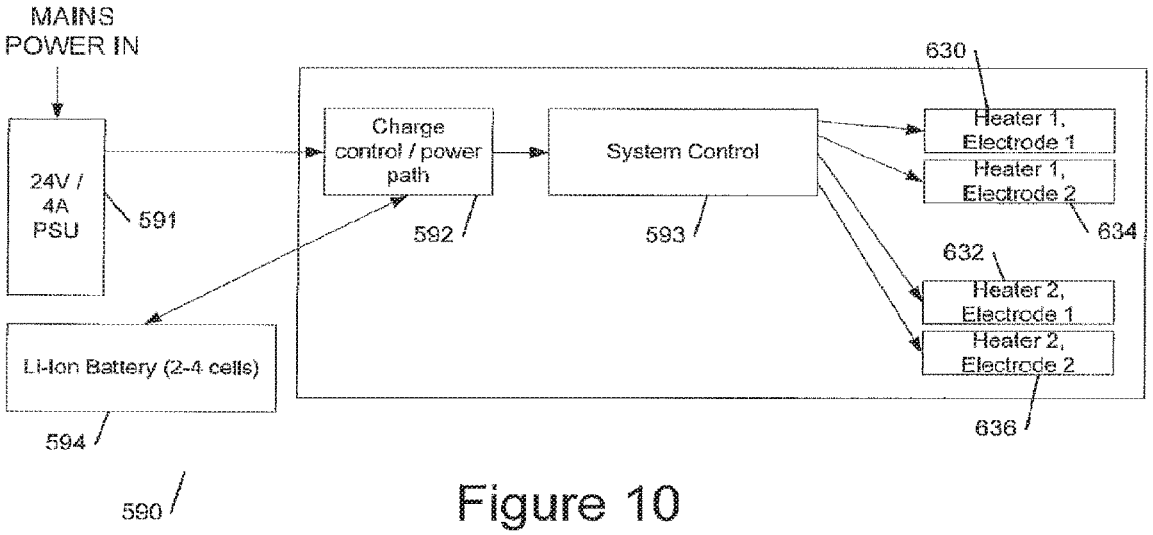
FIG. 10 shows a further embodiment to that of FIGS. 7 to 9 using an external battery pack.

FIG. 10 shows a further embodiment to that of FIGS. 7 to 9 using an external/removeable battery pack in addition to operating from an external power supply. In this variant the battery pack is provided as a removeable module 594. The battery pack may be an interchangeable unit that can slot in or clip onto the styling appliance, allowing a user to carry spares. Using a removeable battery pack may further allow for different capacity modules to be used, depending on the user's preference for portability versus available styling time.

In the variant of FIG. 10, three modes of operation are again possible as described with reference to FIG. 7.

Referring now to FIG. 11, this shows an example of a heater plate with two heating zones 600*a* and 600*b*, and dual drive electrodes for each heating zone. In the first zone 600*a*, heater electrodes 630 and 634 provide a battery driven heater electrode and external power supply driven electrode respectively. In the second zone 600*b* heater electrodes 632 and 636 provide a further battery driven heater electrode and external power supply driven electrode respectively. Thus, in a variant of the embodiment illustrated in FIG. 4, a heater plate may be provided with a plurality of separately controllable heating zones. Connections to these heating zones are also brought out, for convenience, to one edge of the heater plate. As with FIG. 4 a broadened track region 638, 640 may be provided for the electrode further from the connection point to reduce heating in the connection path. In variants that do not provide multiple heating zones such broadening may not be necessary.

Figure 13A:
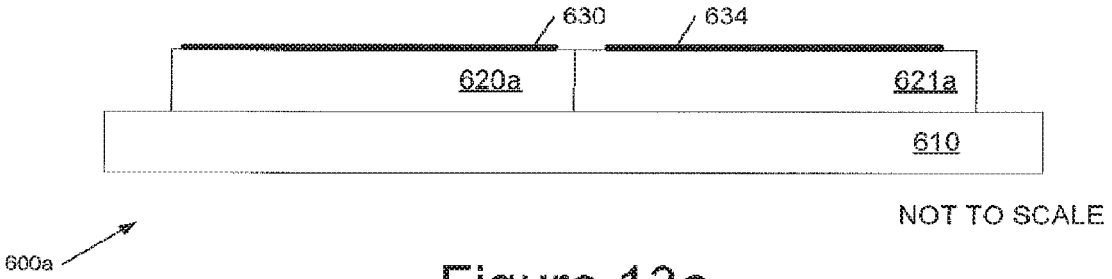
FIGS. 13*a* and 13*b* show, respectfully, cross-sectional views of embodiments of a heater for a hair straightener and a hair curler according to the invention.
Figure 13B:
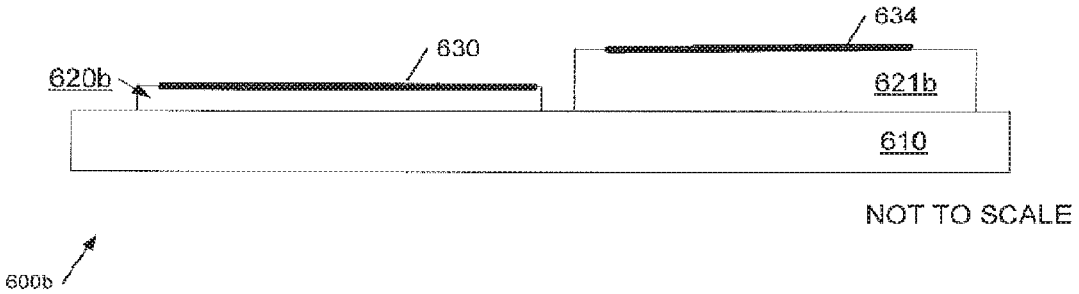

Referring now to FIGS. 13*a* and 13*b*, these show a hair styling heater 600*a* and 600*b* comprising an aluminium heater plate 610 of thickness of the order 1 mm, bearing a plasma electrolytic oxide (PEO) coating of aluminium oxide 620*a*, 621*a*, 620*b* and 621*b*. The thickness of each oxide layer may be less than 100 μm, for example in the range 5-15 μm. Further details of plasma electrolytic oxidation process are set out with reference to FIG. 3*a*.

In the embodiment in FIG. 13*a*, two electrodes 630 and 634 are separated from the metal plate by oxide regions 620*a*, 621*a*. Electrode 630 is powered by the battery supply and electrode 634 by the mains powered source and at a higher voltage. Both regions of oxide 620*a*, 621*a* have the same thickness meaning that only a single uniform oxide layer can be used. This simplifies the manufacturing process. It will be appreciated that the lower voltage provided by the battery supply means that the oxide region 620*a* under electrode 630 may be thinner that that actually used as shown in FIG. 13*b*.

In the embodiment in FIG. 13*b*, the oxide thickness 620*b* of the lower voltage electrode is less the oxide layer 621*b* under the electrode powered by an external mains powered source.

Figure 14:
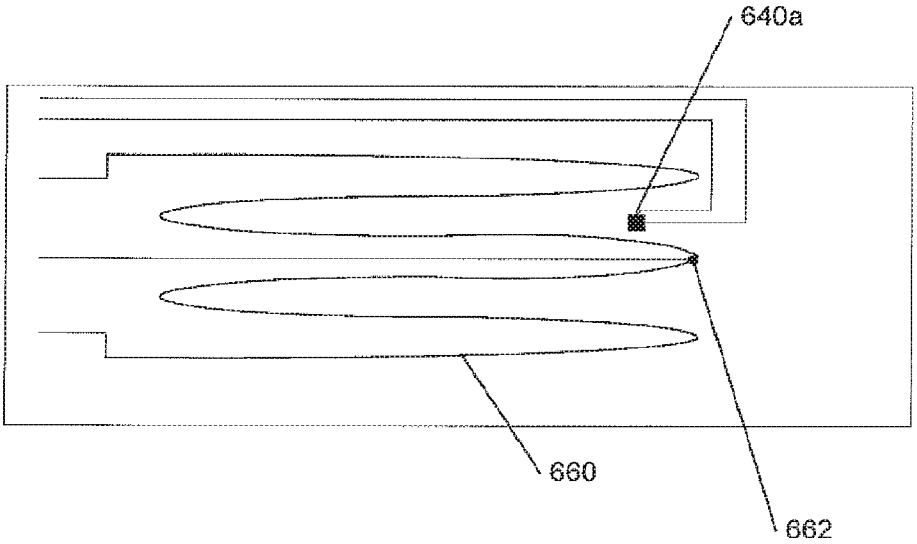
FIG. 14 shows a plan view of an alternative embodiment of the hair styling heater.

FIG. 14 shows a variant of the heater of FIG. 11 and a further electrode arrangement for powering from both a battery source and mains powered external source. In this arrangement, electrode 660 is tapped off at point 662 to form a lower resistance electrode by only using a portion of the full electrode length. In this way, the battery power source then only powers this portion of the electrode 660. When a higher resistance is needed, the full electrode length may be used. This may be useful when a dual drive arrangement is not required and may mean that the layout of electrodes on the heater can be simplified. Selection of a particular resistance/length of electrode may be dependent on which power source is connected and may be controlled by the controller.

Many forms of hair styling heater include a ceramic substrate thermally coupled to a heater plate (such as the aluminium heater plate). To form an aluminium heater, unbaked ('green') ceramic, such as aluminium oxide, may be shaped and then placed on the aluminium heater plate/aluminium substrate and baked (typically at up to 600 degrees C.). By baking the green ceramic on the aluminium plate a molecular bond is formed, providing a thermally and mechanically strong bond. Such a process may be used to form conventional flat hair styling heaters or other shapes, such as curved, cylindrical heaters and the like.

The skilled person will appreciate that the techniques we have described above may be employed for a range of hair styling appliances including, but not limited to, a hair straightener, a hair crimping device, and a hair curler. The skilled person would also appreciate that features from many of the embodiments are interchangeable and not limited to the specific embodiment they are described in relation to.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A hair styling appliance comprising:

a low voltage power supply to provide a voltage of less than 100V to power said hair styling heater; and a body having at least one arm bearing a hair styling heater, said hair styling heater comprising:

a metal sheet or plate, an oxide layer comprising an oxide of said metal on a surface of said metal sheet or plate and a layer of plasma electrolytic oxide; and a heater electrode over said oxide layer, wherein said heater electrode of the heater is coupled to said low voltage power supply, wherein said heater electrode lies over glass which is at least partially merged into a surface of said oxide layer; and/or the appliance further comprises a planarization layer between said oxide layer and said heater electrode, and optionally said planarization layer comprises glass.

2. A hair styling appliance for dual supply voltage operation comprising:

a body having at least one arm bearing a hair styling heater, a low voltage power supply to provide a voltage of less than 100V to power said hair styling heater, wherein said hair styling heater comprises:

a metal sheet or plate, and an oxide layer comprising an oxide of said metal on a surface of said metal sheet or plate, two heater electrodes comprising a first low resistance electrode for said low voltage power supply and a second higher resistance electrode for mains voltage use, wherein said oxide layer comprises a layer of plasma electrolytic oxide.

3. A hair styling appliance configured for dual supply voltage operation and comprising:

a body having at least one arm bearing a hear styling heater;

a battery power supply to provide a DC voltage to power said hair styling heater; and an external power input connectable to a mains powered source to power said hair styling heater, wherein said hair styling heater comprises:

a metal sheet or plate, an oxide layer comprising an oxide of said metal on a surface of said metal sheet or plate, said oxide layer comprising a layer of plasma electrolytic oxide, and at least two heater electrodes over said oxide layer, wherein one of said two heater electrodes is coupled to said DC battery power supply and the other of said two heater electrodes is coupled to said external power input.

4. The hair styling appliance as claimed in claim 3, wherein said heater electrode comprises a conductive ink electrode; and/or said conductive ink electrode is an inorganic conductive ink electrode.

5. The hair styling appliance as claimed in claim 3, further comprising at least one temperature sensor on said oxide layer, and wherein optionally said temperature sensor comprises a printed thermistor.

6. The hair styling appliance as claimed in claim 3, wherein said metal sheet or plate comprises a plurality of laterally-spaced zones, each with a respective said heater electrode.

7. The hair styling appliance as claimed in claim 3, further comprising:

a circuit configured to sense a temperature of said metal sheet or plate from a resistance of said electrode; and/or a hardware electronic shutdown system connected to said electrode in parallel with said low voltage power supply; and/or a guard transistor connected between said low voltage power supply and said heater electrode and a hardware electronic shutdown system coupled to a heater sensor to control said guard transistor; and/or wherein a portion of a track of said heater electrode has a neck to provide an integral fuse.

8. The hair styling appliance as claimed in claim 3, wherein said one of said two heater electrodes coupled to said DC battery power supply has a resistance less than the other of said two heater electrodes coupled to said external power input.

9. The hair styling appliance as claimed in claim 3, further comprising said mains powered source, wherein said mains powered source is configured to convert an AC input to a DC voltage for powering said hair styling heater via said external power input, and said DC voltage from said mains powered source is greater than a voltage provided from said battery power supply.

10. The hair styling appliance as claimed in claim 6, wherein each of said laterally-spaced zones has a respective temperature sensor.

11. The hair styling appliance as claimed in claim 3, wherein said metal sheet or plate has a tubular configuration, with said oxide layer and heater electrode on an interior surface of the tubular configuration.

12. The hair styling appliance as claimed in claim 3, wherein a thickness of said oxide layer is less than 200 μm and above 0 μm.

13. The hair styling appliance as claimed in claim 12, wherein said thickness of said oxide layer is less than 50 μm and above 0 μm.

14. The hair styling appliance as claimed in claim 13, wherein said thickness of said oxide layer is in the range from 5 μm to 15 μm.

15. The hair styling appliance as claimed in claim 3, wherein a thickness of said heater electrode is less than 200 μm and above 0 μm.

16. The hair styling appliance as claimed in claim 15, wherein said thickness of said heater electrode is less than 50 μm and above 0 μm.

17. The hair styling appliance as claimed in claim 16, wherein said thickness of said heater electrode is in the range from 2 μm to 20 μm.

18. The hair styling appliance as claimed in claim 3, wherein said battery power supply comprises a lithium ion battery.

* * * * *